US006110422A

United States Patent [19]

Suarez

[11] Patent Number: 6,110,422

[45] Date of Patent: Aug. 29, 2000

[54] DUCTILE NICKEL-IRON-CHROMIUM ALLOY

[75] Inventor: Francis S. Suarez, Cabell County, W. Va.

[73] Assignee: Inco Alloys International, Inc., Huntington, W. Va.

[21] Appl. No.: 09/359,076

[22] Filed: Jul. 22, 1999

Related U.S. Application Data

[60] Provisional application No. 60/094,011, Jul. 24, 1998.

[51] Int. Cl.[7] ..... C22C 30/00

[52] U.S. Cl. ..... 420/582; 420/586.1

[58] Field of Search ..... 420/582, 586.1

[56] References Cited

U.S. PATENT DOCUMENTS

| | | | |
|---|---|---|---|
| 4,400,209 | 8/1983 | Kudo et al. | 420/443 |
| 4,400,210 | 8/1983 | Kudo et al. | 420/443 |
| 4,400,349 | 8/1983 | Kudo et al. | 420/443 |
| 4,767,597 | 8/1988 | Nishino et al. . | |
| 4,906,437 | 3/1990 | Heubner et al. | 420/443 |
| 5,951,789 | 9/1999 | Ueta et al. | 420/582 |

FOREIGN PATENT DOCUMENTS

| | | |
|---|---|---|
| 57-210939 | 12/1982 | Japan . |
| 596349 | 1/1984 | Japan . |
| 51344 | 8/1993 | Japan . |

OTHER PUBLICATIONS

Marshall J. Wahll et al., "Handbook of Soviet Alloy Compositions", Feb. 1975, p. 16–6.

*Primary Examiner*—Deborah Yee

*Attorney, Agent, or Firm*—Webb Ziesenheim Logsdon Orkin & Hanson, P.C.; Robert F. Dropkin, Esq.

[57] ABSTRACT

A ductile alloy consisting essentially of, by weight percent, 0.05 to 0.4 aluminum, at least 0.003 calcium, 0 to 0.05 carbon, 19.5 to 23.5 chromium, 1.5 to 3 copper, 0 to 1 manganese, 2.5 to 3.5 molybdenum, 38 to 46 nickel, 0.6 to 1.2 titanium and the balance iron and incidental impurities.

9 Claims, 2 Drawing Sheets

DUCTILE NICKEL-IRON-CHROMIUM ALLOY

RELATED APPLICATION

This application claims the benefit of U.S. Provisional Application Ser. No. 60/094,011, filed Jul. 24, 1998, entitled "Ductile Nickel-Iron-Chromium Alloy".

FIELD OF THE INVENTION

This invention relates to nickel-iron-chromium alloys having at least 0.003 weight percent calcium which increases the hot malleability of the alloys.

BACKGROUND OF THE INVENTION

Certain ferrous alloys including INCOLOY® alloy 825 or UNS alloy NO8825 (hereinafter referred to as "alloy 825") are particularly useful for their exceptional resistance to many corrosive environments. INCOLOY® is a trademark of Inco International, Inc. These alloys include nickel, iron, and chromium with additives of molybdenum, copper, and titanium. A typical composition of INCOLOY® alloy 825 by weight percent is provided in Table 1.

TABLE 1

| ALLOY 825 COMPOSITION (WT %) | |
|---|---|
| Aluminum | 0.2 max. |
| Carbon | 0.05 max. |
| Chromium | 19.5–23.5 |
| Copper | 1.5–3.0 |
| Iron | Balance |
| Manganese | 1.0 max. |
| Molybdenum | 2.5–3.5 |
| Nickel | 38.0–46.0 |
| Phosphorus | 0.03 max. |
| Silicon | 0.5 max. |
| Sulfur | 0.03 max. |
| Titanium | 0.6–1.2 |

The nickel content of alloy 825 provides resistance to chloride-ion stress-corrosion cracking. The nickel, in combination with the molybdenum and copper, also gives outstanding resistance to reducing environments such as those containing sulphuric acid or phosphoric acid. The molybdenum provides resistance to pitting and crevice corrosion. The alloy's chromium content confers resistance to a variety of oxidizing substances such as nitric acid, nitrate, and oxidizing salts. The titanium addition serves, with an appropriate heat treatment, to stabilize the alloy against sensitization to interrangular corrosion.

The resistance of alloy 825 to general and localized corrosion under diverse conditions gives the alloy broad usefulness. Alloy 825 is used in chemical processing, pollution control, oil and gas recovery, acid production, pickling operations, nuclear fuel reprocessing, and handling of radioactive wastes.

In order to deoxidize melts of alloy 825, calcium in amounts of 0.001 to less than 0.003 weight percent and about 0.15 percent aluminum have been added to the alloy during an argon oxygen decarburization (AOD) process. Unfortunately, ingots produced with this deoxidation process lack sufficient high temperature ductility for hot rolling various product configurations. Therefore, it has been necessary to use electroslag remelting (ESR) of each ingot to increase the hot workability to sufficient levels for slab conditioning and finishing operations. The additional step of ESR adds significantly to the processing costs of the finished product.

Accordingly, a need remains for an alloy having the corrosion resistance, mechanical properties, and weldability of alloy 825 with enhanced hot ductility which does not require ESR before hot working of the alloy.

SUMMARY OF THE INVENTION

This need is met by the alloy composition of the present invention which includes by weight percent, 0.05 to 0.4 aluminum, 0.003 to 0.1 calcium, 0 to 0.05 carbon, 19.5 to 23.5 chromium, 1.5 to 3 copper, 0 to 1 manganese, 2.5 to 3.5 molybdenum, 38 to 46 nickel, 0.6 to 1.2 titanium and balance iron and incidental impurities. Heats of alloy 825 with 0.003 weight percent to 0.1 weight percent calcium increase the hot ductility of alloy 825 sufficiently to allow commercial fabrication of the alloy without an ESR step. Furthermore, alloys containing at least 0.003 calcium also have corrosion resistance, mechanical properties and weldability equivalent to alloy 825.

DESCRIPTION OF THE PREFERRED EMBODIMENT

Figure 1:
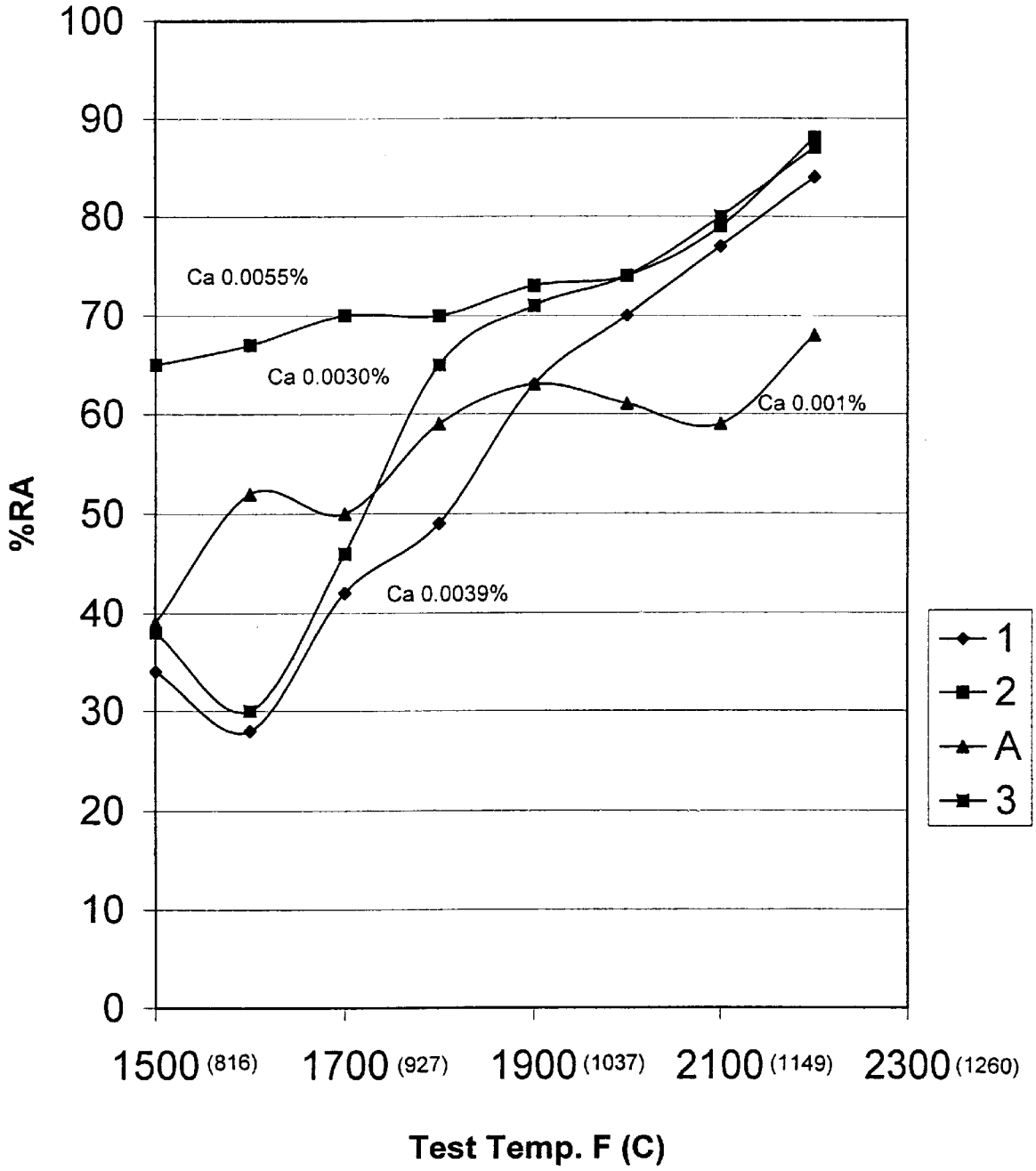
FIG. 1 is a graph of Gleeble data from alloys annealed at 2200° F. (1204° C.) and air-cooled to temperature.

The present invention includes a ferrous alloy containing calcium and meeting the specifications of UNS NO8825 (INCOLOY® alloy 825). Calcium is used to improve the hot workability of alloy 825 so that the conventional required step of ESR is avoided.

The alloy contains at least 0.003 weight percent calcium or over 0.003 weight percent calcium for improved workability. Calcium levels above 0.1 weight percent can deteriorate hot workability of the alloy. Preferably, the alloy contains less than 0.1 or, more preferably, less than 0.05 weight percent calcium. Most preferably, 0.003 to 0.02 weight percent calcium in the alloy increases fabricability without compromising other critical properties. The presence of 0.008 weight percent calcium is particularly beneficial.

Aluminum is included in the alloy to condition the melt. Calcium is a strong deoxidizer of the melt and would be oxidized and floated out from the melt if an additional deoxidizer, aluminum, were not added thereto. The alloy contains about 0.05 to 0.4 weight percent aluminum, preferably 0.15 to 0.30 weight percent aluminum.

In addition to the calcium and aluminum, the preferred amounts by weight percent of the remaining elements of the alloy of the present invention are similar to that of alloy 825 or as follows: 0 to 0.05 carbon, 19.5 to 23.5 chromium, 1.5 to 3 copper, 0 to 1 manganese, 2.5 to 3.5 molybdenum, 38 to 46 nickel, 0.6 to 1.2 titanium and the balance iron and incidental impurities.

The alloy of the present invention is made according to the following process. First, scrap metal containing at least the iron, nickel, and chromium of the final composition is melted in an electric arc furnace in a conventional manner. This premelt is transferred to an argon oxygen decarburization (AOD) vessel where refining and alloying take place. In the deoxidation stage, the calcium is added to the AOD vessel. The majority of calcium tends to react with sulfides and oxides in the melt which then float to the surface of the melt. For this reason, it is necessary to add excess calcium to the melt to yield the desired (lower) amount of calcium at the time ingot is poured. For example, at least 0.025 weight percent calcium may be added to the melt to yield a melt having at least 0.004 weight percent calcium at the time of pouring an ingot. Preferably, the initial melt contains at least 0.05 weight percent calcium to remove sulfur and oxides from the melt. Sufficient aluminum is added to the melt to retain amounts of 0.05 to 0.4 weight percent to enhance the deoxidation of the alloy.

The final molten composition is generally bottom poured into a slab mold (e.g., 20×55×90 inch) to form a slab ingot. The ingot is then overall ground or surface treated and rolled into a plate (e.g., 0.470×51×96 inch), annealed (e.g., at 1700° F.), leveled and shot blasted.

Although the invention has been described generally above, the particular examples give additional illustration of the product and process steps typical of the present invention.

EXAMPLES 1–3

Lab heats of alloys made according to the present invention were produced as follows. Scrap metal known to contain iron, nickel, and chromium with minimal titanium were air induction melted along with calcium and alloying elements to meet the specifications of alloy 825. The resulting molten alloys were cast into four inch diameter test ingots. The final composition by weight of the alloys of Examples 1–3 was determined to be as shown in Table 2.

EXAMPLES 4

A heat of an alloy made according to the present invention was produced as follows. Scrap metal known to contain iron, nickel, and chromium with minimal titanium was melted in an electric arc furnace and transferred to an AOD vessel. Following the addition of conventional alloying elements to meet the specifications of alloy 825, calcium was added to, the AOD vessel and melted. The resulting molten alloy was cast into a 20×55×90 inch slab ingot. The ingot was overall ground and rolled to a 0.470×51×96 inch plate. The plate was directly repeatedly annealed at 1700° F., leveled and shot blasted. The final composition by weight percent of the plate of Example 4 was determined to be as shown in Table 2.

EXAMPLE 5

A heat of an alloy made according to the present invention was produced as a plate as in Example 4 except that the plate was processed using ESR. The final composition by weight percent of the plate of Example 5 was determined to be as shown in Table 2.

COMPARATIVE EXAMPLES A and B

A lab heat of an alloy made in accordance with conventional specifications for alloy 825 was prepared following the process outlined in Examples 1–3 (heat A) and a commercial type heat of alloy 825 was prepared following the process outlined in Example 4 using ESR instead of direct rolling (heat B). ESR was necessary in heat B due to the low levels of calcium in the alloy. The final composition by weight percent of the plates of Comparative Examples A and B was determined to be as shown in Table 2.

TABLE 2

| | Composition Weight Percent | | | | | | |
|---|---|---|---|---|---|---|---|
| | Example | | | | | Comparative Example | |
| Element | 1 (Lab Heat) | 2 (Lab Heat) | 3 (Lab Heat) | 4 (Direct Roll) | 5 (ESR) | A (Lab Heat) | B |
| C | 0.015 | 0.016 | 0.015 | 0.012 | 0.007 | 0.017 | 0.012 |
| Mn | 0.38 | 0.37 | 0.37 | 0.31 | 0.31 | 0.37 | 0.33 |
| Fe | 27.15 | 26.98 | 26.99 | 27.19 | 25.91 | 26.84 | 30.16 |
| S | 0.0022 | 0.0028 | 0.0028 | 0.002 | 0.0011 | 0.0036 | 0.002 |
| Si | 0.20 | 0.19 | 0.21 | 0.36 | 0.11 | 0.23 | 0.11 |
| Cu | 1.66 | 1.66 | 1.65 | 1.7 | 1.72 | 1.59 | 1.9 |
| Ni | 43.75 | 44.13 | 44.02 | 43.8 | 43.89 | 44.98 | 40.6 |
| Cr | 22.47 | 22.20 | 22.23 | 22.5 | 22.58 | 22.19 | 22.5 |
| A1 | 0.09 | 0.13 | 0.18 | 0.1o | 0.11 | 0.06 | 0.09 |
| Ti | 1.01 | 1.01 | 1.02 | 0.9 | 1.16 | 0.83 | 0.9 |
| Co | 0.01 | 0.01 | 0.01 | — | 0.36 | 0.01 | — |
| Mo | 2.90 | 2.98 | 2.98 | 3.1 | 3.25 | 2.58 | 3.4 |
| P | — | — | — | 0.02 | 0.022 | — | 0.02 |
| Ca | 0.0039 | 0.0055 | 0.0030 | 0.0033 | 0.004 | 0.0001 | 0.0011 |

Each of the heats produced in Examples 1–5 and Comparative Examples A and B were tested for hot ductility using the Gleeble method. The products of each of heats 1–5, A and B were rolled down to a 0.5 or ⅝ inch rod. To simulate hot working cycles, the rods of heat 1, 2, 3, and A were tested on cooling from 2200° F. and the rods of heats 4, 5, and B were soaked at 2250° F. and tested on cooling from 2250° F. Each rod tested was held for five seconds at the test temperature prior to determining the area reduction. The results for heats 1, 2, 3, and A are shown in FIG. 1, and the results for heats 4, 5, and B are shown in FIG. 2.

Figure 2:
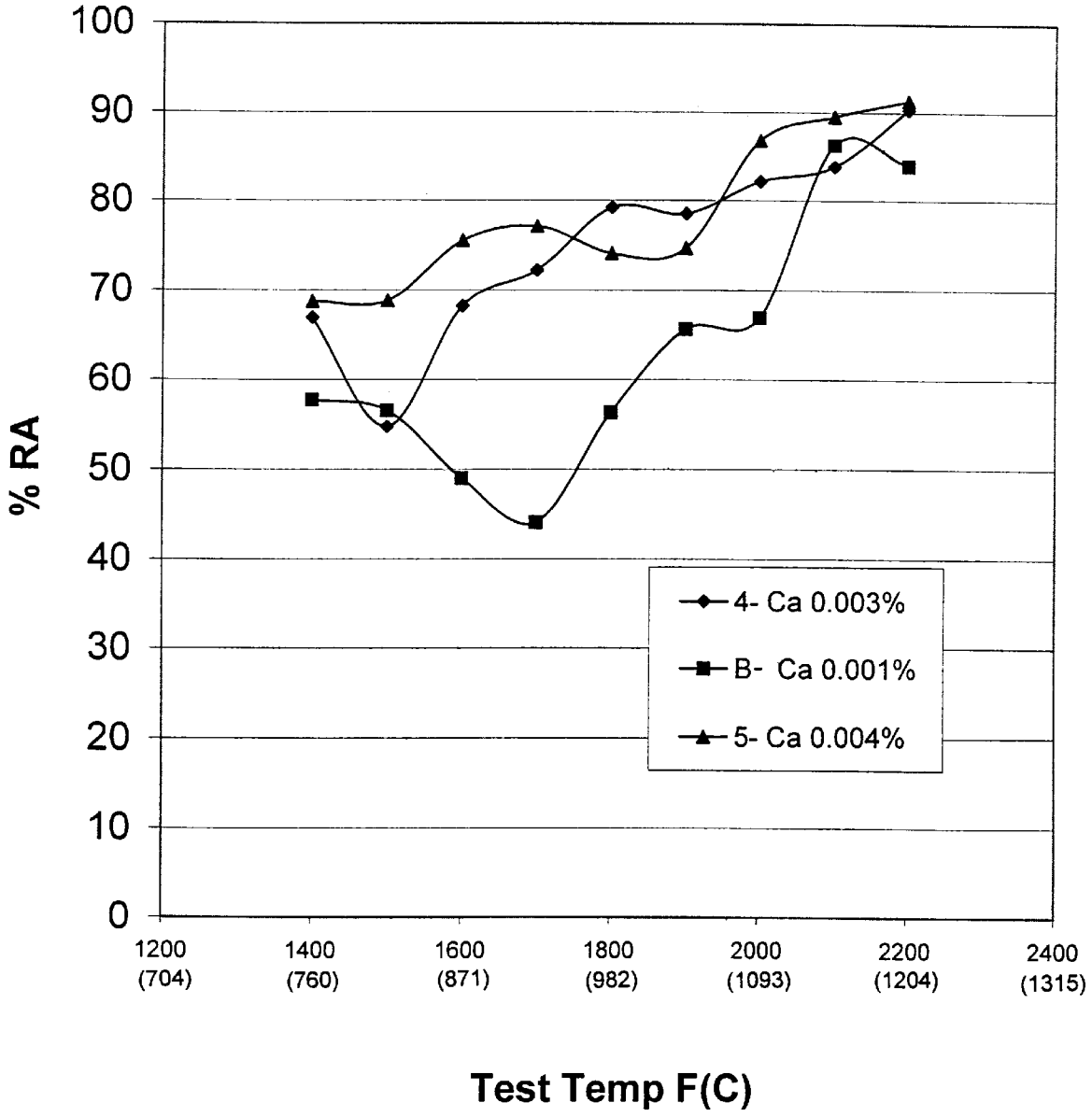
FIG. 2 is a graph of Gleeble data from alloys annealed at 2250° F. (1232° C.) and air-cooled to temperature.

FIGS. 1 and 2 demonstrate that heats of the alloy of the present invention containing at least 0.003 weight percent calcium increases the ductility over heats of alloy 825. The relative decrease in ductility of heat 1 (0.0039 weight percent calcium) from heat 3 (0.003 weight percent calcium) is believed to be due to the lower amount of aluminum present in heat 1. FIG. 2 shows that the ductility of ESR processed alloys of the present invention (Example 5) is also improved over the ductility of ESR processed alloy 825 (Comparative Example B).

Upon further hot working, products from the heats of Examples 4 and 5 were equivalent to the plates produced in Comparative Example B in quality of final surface finish, soundness (determined via ultrasound), microcleanliness, microstructure, corrosion resistance, weldability, and room temperature tensile properties (yield strength, tensile strength, elongation, reduction in area, and hardness). Heats of alloys produced according to the present invention do not require an ESR step as is needed for alloy 825. Hence, the production costs for products made from the alloy of the present invention are lower than the production costs for products made from alloy 825.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

I claim:

1. A ductile alloy consisting essentially of, by weight percent, about 0.05 to 0.4 aluminum, 0.003 to 0.05 calcium, about 0 to 0.05 carbon, about 19.5 to 23.5 chromium, about 1.5 to 3 copper, about 0 to 1 manganese, about 2.5 to 3.5 molybdenum, about 38 to 46 nickel, about 0.6 to 1.2 titanium and the balance iron and incidental impurities.

2. The alloy of claim 1 including at least about 0.0033 calcium.

3. The alloy of claim 1 including about 0.004 to 0.05 calcium.

4. The alloy of claim 1 including about 0.005 to 0.02 calcium.

5. The alloy of claim 1 including about 0.008 calcium.

6. A ductile alloy consisting essentially of, by weight percent, about 0.05 to 0.4 aluminum, 0.003 to 0.05 calcium, about 0 to 0.05 carbon, about 19.5 to 23.5 chromium, about 1.5 to 3 copper, about 0 to 1 manganese, about 2.5 to 3.5 molybdenum, about 38 to 46 nickel, about 0 to 0.03 phosphorus, about 0 to 0.03 sulfur, about 0 to 0.5 silicon, about 0.6 to 1.2 titanium and the balance iron and incidental impurities.

7. The alloy of claim 6 including at least about 0.0033 calcium.

8. The alloy of claim 6 including about 0.004 to 0.05 calcium.

9. The alloy of claim 6 including about 0.005 to 0.02 calcium.

* * * * *

UNITED STATES PATENT AND TRADEMARK OFFICE

CERTIFICATE OF CORRECTION

PATENT NO. : 6,110,422
DATED : August 29, 2000
INVENTOR(S) : Francis S. Suarez

It is certified that error appears in the above-identified patent and that said Letters Patent is hereby corrected as shown below:

Column 5, claim 1,
Line 25, "0.003 to 0.05 calcium" should read -- about 0.003 to 0.05 calcium --."

Column 6, claim 6,
Line 12, "0.003 to 0.05 calcium" should read -- about 0.003 to 0.05 calcium --."

Signed and Sealed this

Twenty-sixth Day of February, 2002

*Attest:*

*Attesting Officer*

JAMES E. ROGAN
*Director of the United States Patent and Trademark Office*